US008431849B2

(12) United States Patent
Chen

(10) Patent No.: US 8,431,849 B2
(45) Date of Patent: Apr. 30, 2013

(54) BACKLIGHTING APPARATUS FOR A KEYPAD ASSEMBLY

(75) Inventor: Chao Chen, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 95 days.

(21) Appl. No.: 12/889,594

(22) Filed: Sep. 24, 2010

(65) Prior Publication Data

US 2012/0073941 A1 Mar. 29, 2012

(51) Int. Cl.
*H01H 13/83* (2006.01)

(52) U.S. Cl.
USPC ..... 200/314; 200/516; 200/310; 200/313

(58) Field of Classification Search ..... 341/22; 345/168–170; 200/5 A, 516, 310–317, 341
See application file for complete search history.

(56) References Cited

U.S. PATENT DOCUMENTS

| | | | | |
|---|---|---|---|---|
| 4,177,501 | A | 12/1979 | Karlin | |
| 7,027,036 | B2 | 4/2006 | Yang | |
| 7,064,288 | B2 * | 6/2006 | Nam | 200/406 |
| 7,223,005 | B2 | 5/2007 | Lamb et al. | |
| 7,364,337 | B2 | 4/2008 | Park | |
| 7,608,792 | B1 | 10/2009 | Tsai | |
| 7,619,173 | B2 * | 11/2009 | Inoue | 200/310 |
| 7,683,279 | B2 | 3/2010 | Kim | |
| 7,888,613 | B2 * | 2/2011 | Jeffery et al. | 200/314 |
| 7,994,445 | B2 * | 8/2011 | Aihara et al. | 200/314 |
| 8,143,541 | B2 * | 3/2012 | Tanabe et al. | 200/310 |
| 2007/0057031 | A1 | 3/2007 | Lee | |
| 2007/0242048 | A1 | 10/2007 | Yang | |
| 2007/0285947 | A1 | 12/2007 | Kim | |
| 2008/0186736 | A1 | 8/2008 | Rinko | |
| 2008/0267572 | A1 | 10/2008 | Sampsell et al. | |
| 2009/0122016 | A1 | 5/2009 | Huang | |
| 2009/0145733 | A1 * | 6/2009 | Tatehata et al. | 200/314 |
| 2009/0173607 | A1 | 7/2009 | Lee et al. | |
| 2009/0283394 | A1 | 11/2009 | Masuda | |
| 2010/0108486 | A1 * | 5/2010 | Yoshida | 200/520 |
| 2010/0133083 | A1 * | 6/2010 | Watanabe et al. | 200/5 R |
| 2010/0148996 | A1 | 6/2010 | Wang | |
| 2010/0200381 | A1 | 8/2010 | Kuo | |
| 2011/0079497 | A1 * | 4/2011 | Ng et al. | 200/314 |

FOREIGN PATENT DOCUMENTS

| | | |
|---|---|---|
| EP | 1729205 A2 | 12/2006 |
| EP | 1901321 A2 | 3/2008 |
| EP | 2063297 A1 | 5/2009 |

(Continued)

OTHER PUBLICATIONS

Web page. Top Bound USA, "Light Guide Film." Available: http://topboundusa.com/keypads.html.

(Continued)

*Primary Examiner* — Michael Friedhofer
(74) *Attorney, Agent, or Firm* — Bereskin and Parr LLP/S.E.N.C.R.L., s.r.l.

(57) ABSTRACT

A keypad assembly including a dome configured to operatively engage a switch sensor; a dome overlay guide operatively coupled by to the dome; a key corresponding to the dome and configured to operatively engage the dome; and a light emitting source, configured to emit light. The dome overlay guide is configured to receive the light emitted by the light emitting source and direct the received light toward the keys.

16 Claims, 5 Drawing Sheets

FOREIGN PATENT DOCUMENTS

| | | | |
|---|---|---|---|
| EP | 2141716 | A1 | 1/2010 |
| KR | 20060120514 | A | 11/2006 |
| WO | 2007102633 | A1 | 9/2007 |
| WO | 2009157218 | A1 | 12/2009 |

OTHER PUBLICATIONS

Web page. Shin-Etsu, "Shin-Etsu keypad AP-I type." Available: http://www.shinetsu.co.jp/e/materials/electronics/index.shtml.

Co-pending U.S. Appl. No. 12/874,269. "Backlighting Assembly for a Keypad," filed Sep. 2, 2010.

Examination Report received on corresponding European Application No. 10179232.3, dated Jan. 18, 2012.

Extended European Search Report (European Application No. 10179232.3) dated Feb. 7, 2011.

Extended European Search Report (European Application No. 10175018.0) dated Feb. 7, 2011.

Web page. Top Bound USA, "Light Guide Film" Available: http://topboundusa.com/keypads.html.

Web page. Wikipedia, "Blacklight / Light Guide Plate." Available:http://en.wikipedia.org/wiki/Light_guide_plate.

Web page. Electronicstalk, "Light guide film is ideal for backlighting tasks." Available: http://www.electronicstalk.com/news/agi/agi488.html.

Web page. Fujipoly, "Fujipoly Light Guide Film." Available: http://www.fujipoly.co.jp/english/products/other_04/index.htm.

Second Examination Report received on corresponding European Application No. 10179232.3, dated Jun. 19, 2012.

Response as filed on European Application No. 10179232.3, dated Oct. 19, 2012.

Office Action as issued on copending U.S. Appl. No. 12/874,269, dated Oct. 17, 2012.

Response to Office Action, as submitted on copending U.S. Appl. No. 12/874,269, dated Dec. 14, 2012.

Third Examination Report received on related European Application No. 10179232.3, dated Feb. 27, 2013.

Second Office Action, as issued on copending U.S. Appl. No. 12/874,269, dated Mar. 1, 2013.

* cited by examiner

BACKLIGHTING APPARATUS FOR A KEYPAD ASSEMBLY

RELEVANT FIELD

The field of this disclosure relates generally to keypads and keypad backlighting, with particular but by no means exclusive application to keypads of mobile communications devices.

BACKGROUND

It is often desirable to provide backlighting to the keys of a keypad assembly used in electronic devices such as mobile communications devices during darkened conditions. Light may be emitted from a light source located within the electronic device, and directed toward one or multiple keys illuminating such key(s).

BRIEF DESCRIPTION OF THE DRAWINGS

Embodiments are described in further detail below, by way of example only, with reference to the accompanying drawings, in which.

DETAILED DESCRIPTION

Figure 1:
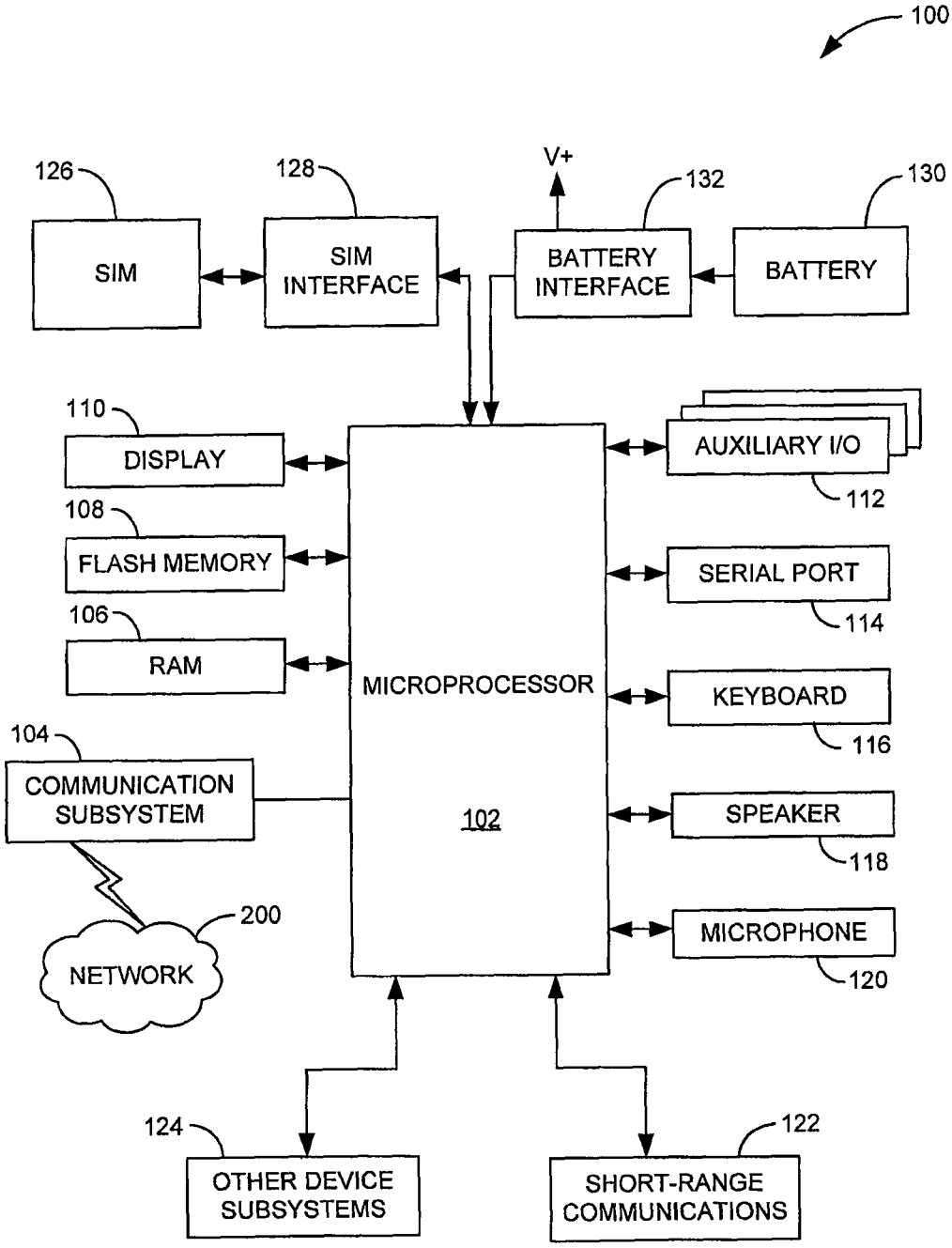
FIG. 1 is a block diagram of a mobile device in one example implementation.

In one broad aspect, there is provided a keypad assembly. The keypad assembly includes a dome configured to operatively engage a switch sensor; a dome overlay guide operatively coupled to the dome; a key corresponding to the dome, and configured to operatively engage the dome; and a light emitting source configured to emit light. The dome overlay guide is configured to receive the emitted light and direct the received light toward the key.

The dome overlay guide may include a light guide film. The keypad assembly may also include a reflector layer configured to reflect light escaping the dome overlay guide. The reflector layer may be configured to reflect the escaping light toward the key. The dome overlay guide may be between the reflector layer and the key.

The operative coupling may include an adhesive. The keypad assembly may also include a deflection web configured to seat the key, wherein the deflection web is between the key and the dome overlay guide.

The light emitting source may include a side firing light emitting diode. The keypad assembly may include a plurality of keys, and a plurality of corresponding domes.

In another broad aspect, there is provided a mobile device comprising the keypad assembly.

In a third broad aspect, there is provided a keypad assembly. The keypad assembly includes a dome configured to operatively engage a switch sensor; a dome overlay guide operatively coupled to the dome; a key corresponding to the dome, and configured to operatively engage the dome; a deflection web configured to seat the key; and a side firing light emitting source configured to emit light. The dome overlay guide is configured to receive the emitted light, and direct the received light toward the key; and an actuator is adjacent a portion of an upper surface of the dome overlay guide.

The dome overlay guide may include a light guide film. The keypad assembly may also include a reflector layer configured to reflect light escaping the dome overlay guide. The reflector layer may be configured to reflect the escaping light toward the key.

The keypad assembly may also include a printed circuit board, wherein the reflector layer is positioned between the printed circuit board and the dome overlay guide. The dome overlay guide may be adhered to the reflector layer.

The dome overlay guide may include at least one cavity configured to emit the received light in a direction toward the key. The side firing light emitting source may include a light emitting diode.

In another broad aspect, there is provided a method for providing backlighting for a keypad assembly, the keypad assembly comprising a printed circuit board having a switch sensor, a key corresponding to the switch sensor, and a light emitting source configured to emit light. The method includes providing a dome corresponding to the switch sensor; adhering a light guide film to the dome; and securing the light guide film within the keypad assembly, wherein the film is configured to receive the emitted light, and wherein the dome is configured to operatively engage the switch sensor.

The method may also include adhering a reflector layer to the light guide film.

Some embodiments of the system and methods described herein make reference to a mobile device. A mobile device may be a two-way communication device with advanced data communication capabilities having the capability to communicate with other computer systems. A mobile device may also include the capability for voice communications. Depending on the functionality provided by a mobile device, it may be referred to as a data messaging device, a two-way pager, a cellular telephone with data messaging capabilities, a wireless Internet appliance, or a data communication device (with or without telephony capabilities), for example. A mobile device may communicate with other devices through a network of transceiver stations.

To aid the reader in understanding the structure of a mobile device, reference is made to FIG. 1.

FIG. 1 is a block diagram of a mobile device in one example implementation, shown generally as 100. Mobile device 100 comprises a number of components, the controlling component being microprocessor 102. Microprocessor 102 controls the overall operation of mobile device 100. Communication functions, including data and voice communications, may be performed through communication subsystem 104. Communication subsystem 104 may be configured to receive messages from and send messages to a wireless network 200. In one example implementation of mobile device 100, communication subsystem 104 may be configured in accordance with the Global System for Mobile Communication (GSM) and General Packet Radio Services (GPRS) standards. The GSM/GPRS wireless network is used worldwide and it is expected that these standards may be supplemented or superseded eventually by Enhanced Data GSM Environment (EDGE) and Universal Mobile Telecommunications Service (UMTS), and Ultra Mobile Broadband (UMB), etc. New standards are still being defined, but it is believed that they will have similarities to the network behaviour described herein, and it will also be understood by persons skilled in the art that the embodiments of the present disclosure are intended to use any other suitable standards that are developed in the future. The wireless link connecting communication subsystem 104 with network 200 represents one or more different Radio Frequency (RF) channels, operating according to defined protocols specified for GSM/GPRS communications. With newer network protocols, these channels are capable of supporting both circuit switched voice communications and packet switched data communications.

Although the wireless network associated with mobile device 100 is a GSM/GPRS wireless network in one example implementation of mobile device 100, other wireless networks may also be associated with mobile device 100 in variant implementations. Different types of wireless networks that may be employed include, for example, data-centric wireless networks, voice-centric wireless networks, and dual-mode networks that can support both voice and data communications over the same physical base stations. Combined dual-mode networks include, but are not limited to, Code Division Multiple Access (CDMA) or CDMA2000 networks, GSM/GPRS networks (as mentioned above), and future third-generation (3G) networks like EDGE and UMTS. Some older examples of data-centric networks include the Mobitex™ Radio Network and the DataTAC™ Radio Network. Examples of older voice-centric data networks include Personal Communication Systems (PCS) networks like GSM and Time Division Multiple Access (TDMA) systems. Other network communication technologies that may be employed include, for example, Integrated Digital Enhanced Network (iDEN™), Evolution-Data Optimized (EV-DO), and High Speed Packet Access (HSPA), etc.

Microprocessor 102 may also interact with additional subsystems such as a Random Access Memory (RAM) 106, flash memory 108, display 110, auxiliary input/output (I/O) subsystem 112, serial port 114, keyboard 116, speaker 118, microphone 120, short-range communications subsystem 122 and other device subsystems 124.

Some of the subsystems of mobile device 100 perform communication-related functions, whereas other subsystems may provide "resident" or on-device functions. By way of example, display 110 and keyboard 116 may be used for both communication-related functions, such as entering a text message for transmission over network 200, as well as device-resident functions such as a calculator or task list. Operating system software used by microprocessor 102 is typically stored in a persistent store such as flash memory 108, which may alternatively be a read-only memory (ROM) or similar storage element (not shown). Those skilled in the art will appreciate that the operating system, specific device applications, or parts thereof, may be temporarily loaded into a volatile store such as RAM 106.

Mobile device 100 may send and receive communication signals over network 200 after network registration or activation procedures have been completed. Network access may be associated with a subscriber or user of a mobile device 100. To identify a subscriber, mobile device 100 may provide for a Subscriber Identity Module ("SIM") card 126 to be inserted in a SIM interface 128 in order to communicate with a network. SIM card 126 may be one example type of a conventional "smart card" used to identify a subscriber of mobile device 100 and to personalize the mobile device 100, among other things. Without SIM card 126, mobile device 100 may not be fully operational for communication with network 200. By inserting SIM card 126 into SIM interface 128, a subscriber may access all subscribed services. Services may include, without limitation: web browsing and messaging such as e-mail, voice mail, Short Message Service (SMS), and Multimedia Messaging Services (MMS). More advanced services may include, without limitation: point of sale, field service and sales force automation. SIM card 126 may include a processor and memory for storing information. Once SIM card 126 is inserted in SIM interface 128, it may be coupled to microprocessor 102. In order to identify the subscriber, SIM card 126 may contain some user parameters such as an International Mobile Subscriber Identity (IMSI). By using SIM card 126, a subscriber may not necessarily be bound by any single physical mobile device. SIM card 126 may store additional subscriber information for a mobile device as well, including datebook (or calendar) information and recent call information.

Mobile device 100 may be a battery-powered device and may comprise a battery interface 132 for receiving one or more rechargeable batteries 130. Battery interface 132 may be coupled to a regulator (not shown), which assists battery 130 in providing power V+ to mobile device 100. Although current technology makes use of a battery, future technologies such as micro fuel cells may provide power to mobile device 100. In some embodiments, mobile device 100 may be solar-powered.

Microprocessor 102, in addition to its operating system functions, enables execution of software applications on mobile device 100. A set of applications that control basic device operations, including data and voice communication applications, may be installed on mobile device 100 during its manufacture. Another application that may be loaded onto mobile device 100 is a personal information manager (PIM). A PIM has functionality to organize and manage data items of interest to a subscriber, such as, but not limited to, e-mail, calendar events, voice mails, appointments, and task items. A PIM application has the ability to send and receive data items via wireless network 200. PIM data items may be seamlessly integrated, synchronized, and updated via wireless network 200 with the mobile device subscriber's corresponding data items stored and/or associated with a host computer system. This functionality may create a mirrored host computer on mobile device 100 with respect to such items. This can be particularly advantageous where the host computer system is the mobile device subscriber's office computer system.

Additional applications may also be loaded onto mobile device 100 through network 200, auxiliary I/O subsystem 112, serial port 114, short-range communications subsystem 122, or any other suitable subsystem 124. This flexibility in application installation increases the functionality of mobile device 100 and may provide enhanced on-device functions, communication-related functions, or both. For example, secure communication applications may enable electronic commerce functions and other such financial transactions to be performed using mobile device 100.

Serial port 114 enables a subscriber to set preferences through an external device or software application and extends the capabilities of mobile device 100 by providing for information or software downloads to mobile device 100 other than through a wireless communication network. The alternate download path may, for example, be used to load an encryption key onto mobile device 100 through a direct and thus reliable and trusted connection to provide secure device communication.

Short-range communications subsystem 122 provides for communication between mobile device 100 and different systems or devices, without the use of network 200. For example, subsystem 122 may include an infrared device and associated circuits and components for short-range communication. Examples of short range communication include standards developed by the Infrared Data Association (IrDA), Bluetooth®, and the 802.11 family of standards (Wi-Fi®) developed by IEEE.

In use, a received signal such as a text message, an e-mail message, or web page download is processed by communication subsystem 104 and input to microprocessor 102. Microprocessor 102 then processes the received signal for output to display 110 or alternatively to auxiliary I/O subsystem 112. A subscriber may also compose data items, such as e-mail messages, for example, using keyboard 116 in conjunction with display 110 and possibly auxiliary I/O subsystem 112. Auxiliary subsystem 112 may include devices such as: a touch screen, mouse, track ball, optical trackpad infrared fingerprint detector, or a roller wheel with dynamic button pressing capability. Keyboard 116 may comprise an alphanumeric keyboard and/or telephone-type keypad, for example. A composed item may be transmitted over network 200 through communication subsystem 104.

For voice communications, the overall operation of mobile device 100 may be substantially similar, except that the received signals may be processed and output to speaker 118, and signals for transmission may be generated by microphone 120. Alternative voice or audio I/O subsystems, such as a voice message recording subsystem, may also be implemented on mobile device 100. Although voice or audio signal output is accomplished primarily through speaker 118, display 110 may also be used to provide additional information such as the identity of a calling party, duration of a voice call, or other voice call related information.

Figure 2:
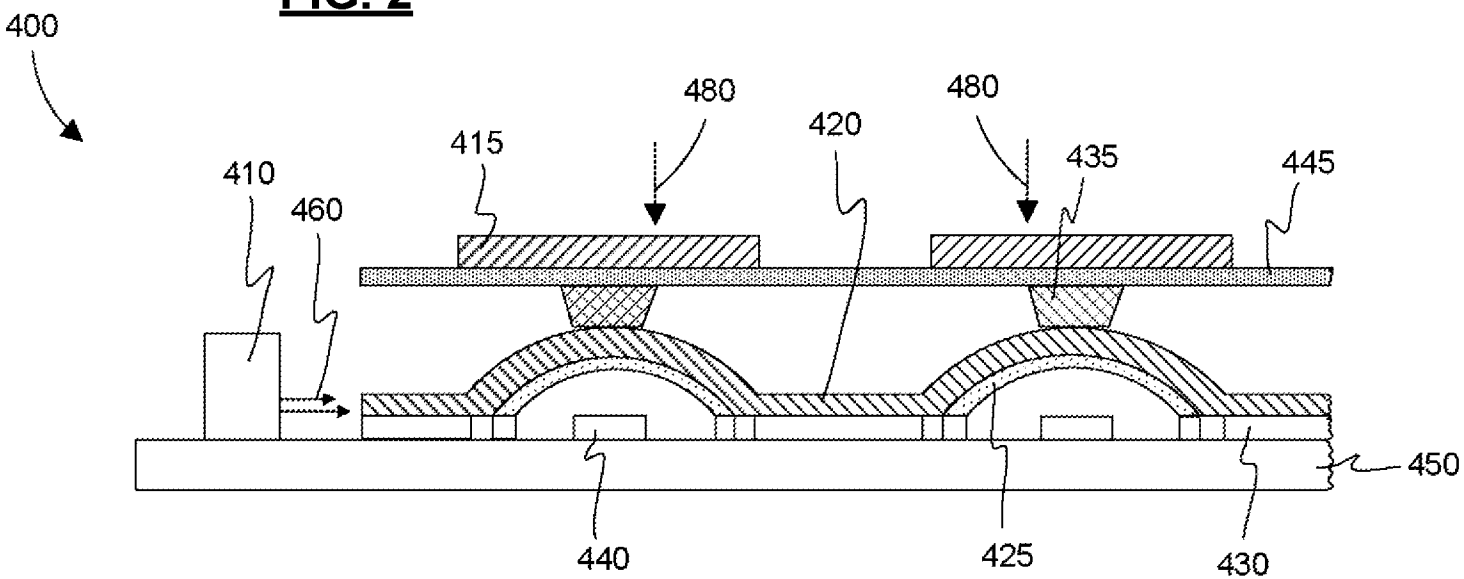
FIG. 2 is a section view of a keypad assembly according to an embodiment of the present disclosure.

Referring now to FIG. 2, a keypad assembly according to an embodiment is shown generally as 400. The keypad assembly 400 may be used within electronic devices, such as the mobile device 100 described above. For example, the keypad assembly 400 may comprise part of the keyboard 116.

The keypad assembly 400 comprises a plurality of keys (or keycaps) 415 which may be arranged on a deflection web 445. Each of the keys 415 is operatively coupled to at least one switch sensor 440. The switch sensor 440 detects if the corresponding key has been pressed and if so it generates a corresponding signal on a printed circuit board 450.

Separating a key 415 from its corresponding switch sensor 440 may be a corresponding dome 425 that is operatively coupled to the switch sensor 440. The dome 425 may be made of metal or another suitable material (or a combination thereof) and may be configured to collapse and contact the switch sensor 440 when the corresponding key 415 is depressed in the key press direction 480 (i.e. the direction 480 in which a key 415 may be depressed). To this end, the key 415 may be configured to operatively engage the dome 425 via an actuator 435. The actuator 435 may comprise part of and extend from the deflection web 445. Specifically, the actuator 435 may be positioned between the key 415 and the dome 425 and it may transfer the key depression force, onto the dome 425. Persons skilled in the art will understand that the domes 425 and the switch sensors 440 may operate like dome switches known in the art.

Figure 3:
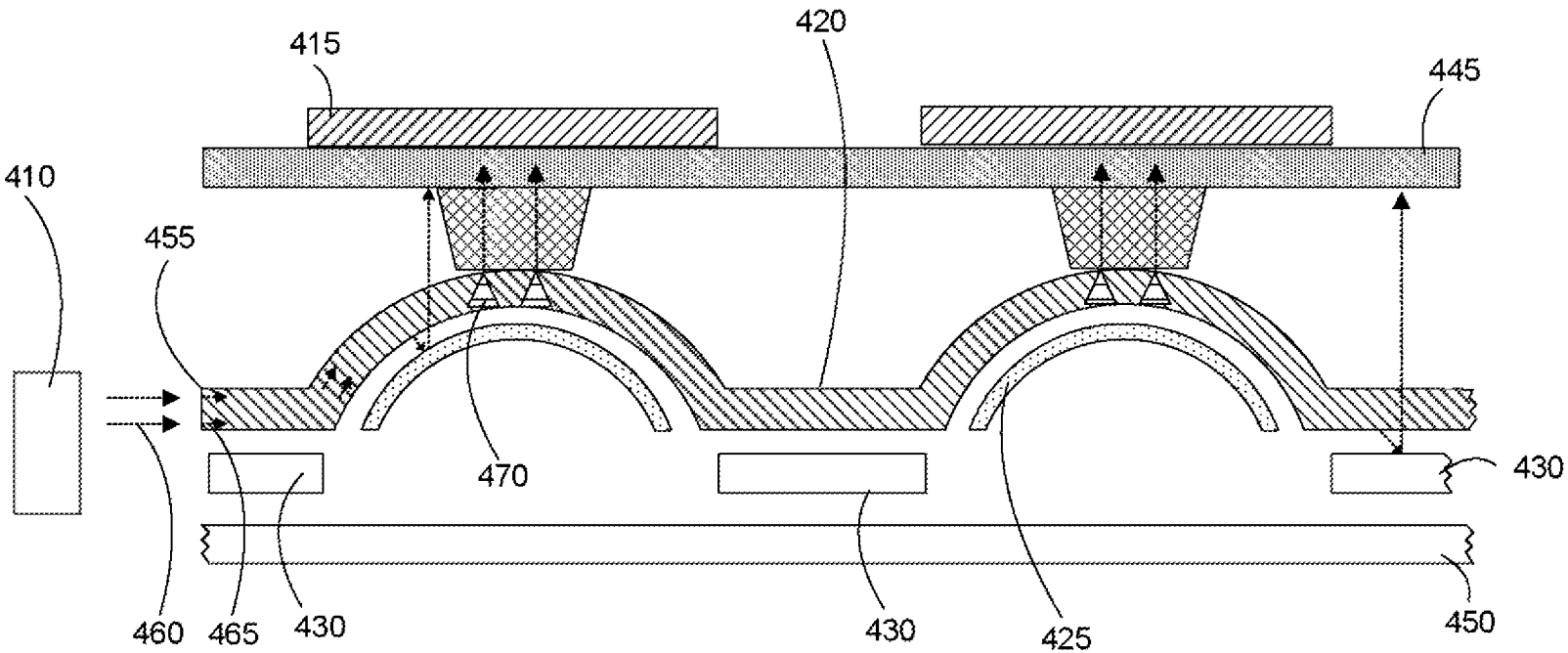
FIG. 3 is an enlarged section view of selected elements of the keypad assembly of FIG. 2.

The keypad assembly 400 includes a light emitting source 410 configured to emit light for illuminating the keys 415. To distribute the light emitted by the light emitting source 410 (referred to hereinafter as "emitted light" 460) to the plurality of keys 415, a dome overlay guide 420 is provided. The dome overlay guide 420 is configured to receive the emitted light 460 (referred to hereinafter as "received light" 465) and direct the received light toward the keys (FIG. 3). To this end, the dome overlay guide 420 may comprise a light guide film.

The dome overlay guide 420 may also serve to keep the domes 425 aligned with their corresponding switch sensors 440. To this end, the dome overlay guide 420 may overlay and be operatively coupled, by adhesive or otherwise, to the domes 425.

Persons skilled in the art will appreciate that the keys 415 may be held in place in any suitable manner. For example, the keys 415 may be adhered (using an adhesive or otherwise) to the deflection web 445. In some embodiments (not shown), one or both of the deflection web 445 and the actuators 435 may be configured to seat the keys 415. In such a "seating" embodiment, the keys 415 and the one or both of the deflection web 445 and the actuators 435 may be provided with complementary male (such as a post) and female (such as a seat) features to permit the keys 415 to sit within the one or both of the deflection web 445 and the actuators 435.

Referring now to FIG. 3, the illumination of the keys 415 by the light emitting source 410 is discussed in more detail. The light emitting source 410 is positioned adjacent and oriented towards an edge 455 of the dome overlay guide 420, such that light 460 emitted from the light emitting source 410 is received by the dome overlay guide 420 through its edge 455.

To redirect the received light 465 out of the dome overlay guide 420 toward the keys 415, the dome overlay guide 420 may be provided with several micro features 470. The micro features 470 may be provided at predetermined locations of the dome overlay guide 420 so as to align with the keys 415. When the received light 465 traveling through the dome overlay guide 420 intersects with a micro feature 470, a portion of the received light 465 is redirected toward the key 415 which is aligned with that micro feature 470.

Persons skilled in the art will understand that the micro features 470 have been illustrated schematically and that any micro features suitable for redirecting received light 465 may be used. For example, the micro features 470 may comprise one or more cavities etched into a surface of the dome overlay guide 420. These cavities may, for example, comprise v-shaped cuts, or white printing dots (or micro dots). In some variants, a two dimensional array of micro features 470 on the surface of the dome overlay guide 420 may be provided to help evenly redirect received light 465 toward the keys 415.

Received light 465 traveling through the dome overlay guide 420 may escape (or leak) from the dome overlay guide 420 toward one or more of the printed circuit board 450 and the domes 425. The escape of light from the dome overlay guide 420 may be most common wherever the dome overlay guide 420 is adhered to another surface using an adhesive. The escape of light caused by the use of an adhesive on the dome overlay guide 420 is sometimes referred to as wet out.

In some embodiments, to recapture at least a portion of the received light 465, which escapes the dome overlay guide 420 toward the domes 425 and the printed circuit board 450, the domes 425 and the printed circuit board 450 may be configured to be sufficiently reflective to reflect such escaped light back toward the keys 415. For example, the domes 425 may be one of polished, provided with a reflective coating (for example, silver plating) or naturally reflective. Similarly, a reflector layer 430 may be provided between the dome overlay guide 420 and the printed circuit board 450. The reflector layer 430 may be configured to reflect escaping light back toward the keys 415. The side of the reflector layer 430, which faces the dome overlay guide 420, may be provided with a reflective coating or may be naturally reflective. In some embodiments, the reflector layer 430 may comprise a polymeric specular reflector film, such as for example Vikuiti™ Enhanced Specular Reflector film, as distributed by 3M Optical Systems.

The deflection web 445 and the actuators 435 may be made from a substantially translucent (or semitransparent) material. This may permit a relatively high portion of light emitted from the dome overlay guide 420 to pass through the deflection web 445 and the actuators 435 and reach the key(s) 415.

The light emitting source 410 may comprise a side firing (or side emitting) light emitting diode (LED) as may be known in the art. Persons skilled in the art will understand that a side firing LED typically comprises a housing for the LED that is mountable at a base of the housing and an LED configured to emit light from a side wall—adjacent the base—of the housing. In contrast, the housing of a top firing LED, which is also mountable at its base, contains an LED configured to emit light from a top surface—opposite the base—of the housing.

Persons skilled in the art will appreciate that LEDs typically require there to be a certain amount of clearance (or space) between the surface of the LEDs, from which the light is emitted, and a light guide or other object in order for the LEDs to function efficiently. This space is typically referred to as the LED leading space gap. When using side firing LEDs (i.e. LEDs which emit light in a direction that is generally perpendicular to the key press direction 480), as opposed to top firing LEDs (i.e. LEDs which emit light in a direction that is generally parallel to the key press direction 480), as the light emitting source 410 within a keypad assembly 400, any required leading space gap is lateral (i.e. generally perpendicular to the key press direction 480) rather than vertical (i.e. generally parallel to the key press direction 480). Consequently, the thickness of the keypad assembly 400 may be reduced by using side firing LEDs instead of top firing LEDs as the light emitting source 410 within a keypad assembly 400.

Figure 4:
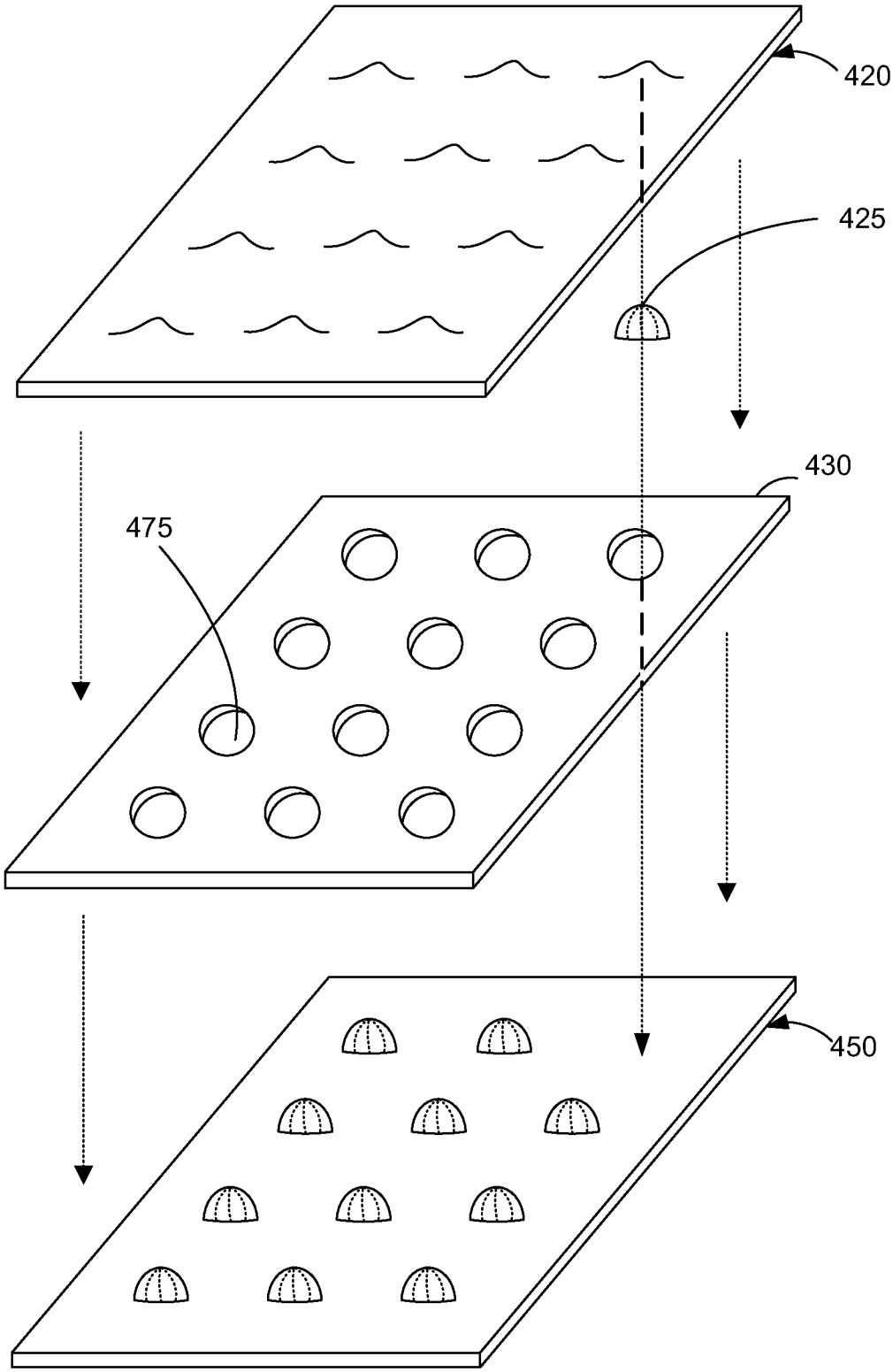
FIG. 4 is an exploded perspective view of selected elements of the keypad assembly.

Referring now to FIG. 4, the alignment and configuration of the reflector layer 430 is discussed in greater detail. FIG. 4 shows an exploded view of the dome overlay guide 420, the reflector layer 430, and the printed circuit board 450 with the domes 425. The reflector layer 430 is provided with apertures 475, each of which corresponds to a dome 425. Specifically, when the reflector layer 430 is coupled to the printed circuit board 450, by adhesive or otherwise, the domes 425 each project out of their corresponding aperture 475. Further, when the dome overlay guide 420 is coupled to the domes 425, those areas of the dome overlay guide 420 that are not coupled to the domes 425 may be optionally adhered to the reflector layer 430.

Persons having ordinary skill in the art will understand that the reflector layer 430 may comprise any number and arrangement of apertures 475. Similarly the keypad assembly 400 may comprise any number and arrangement of keys 415. For example, FIG. 4 shows an example reflector layer 430 with twelve apertures 475 for use with a standard alphanumeric twelve-key keypad assembly (0-9, #, *). Those of ordinary skill the art will appreciate that other configurations of the reflector layer 430 and keys 415 may also exist to correspond to keypad assemblies with different numbers and/or arrangements of keys (e.g. a full QWERTY keypad assembly).

Figure 5:
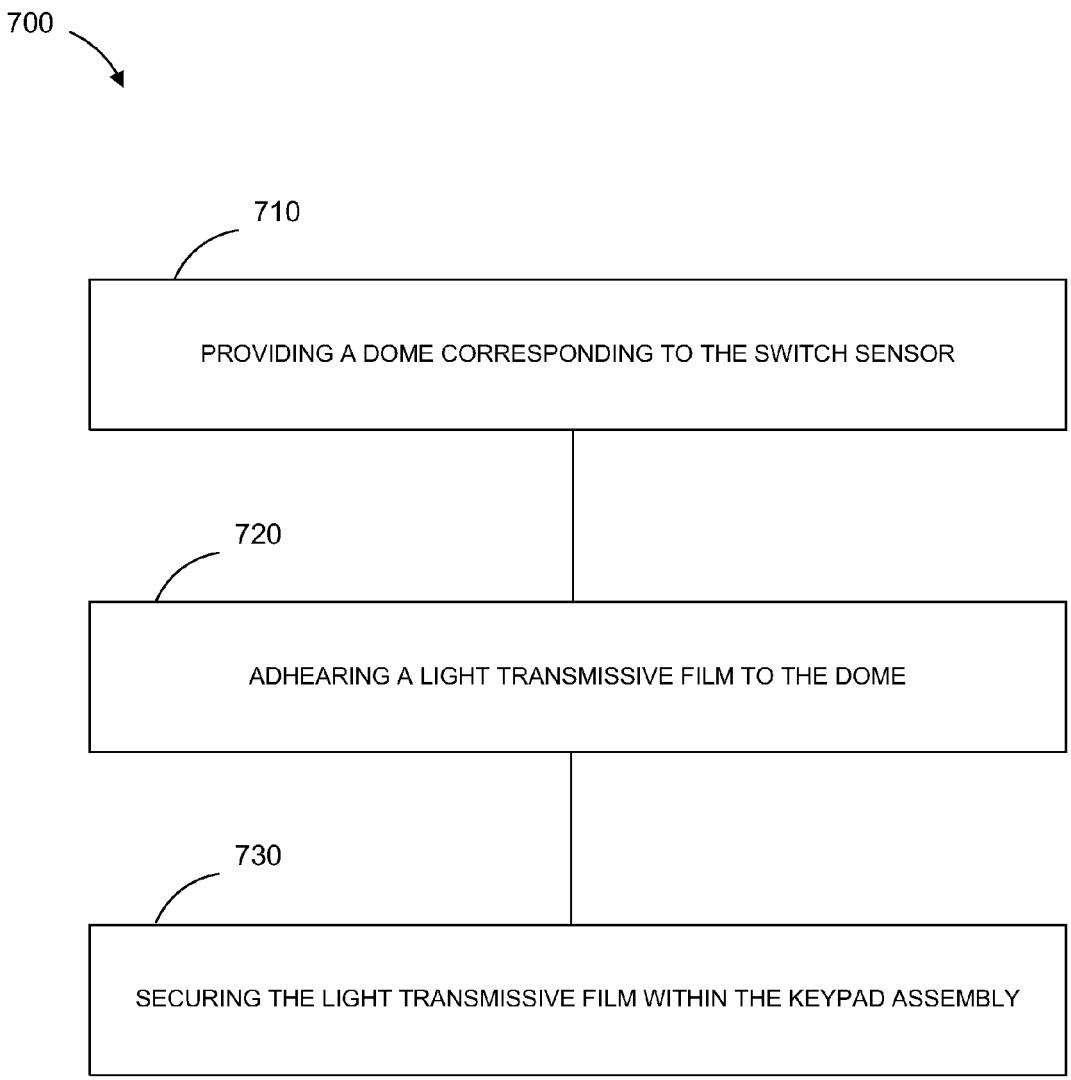
FIG. 5 is a logical flow diagram of a method for providing backlighting for a keypad assembly according to the present disclosure.

Referring now to the logical flow diagram of FIG. 5, a method (referred to generally as 700) for providing backlighting for a keypad assembly 400 comprising a printed circuit board 450 having a switch sensor 440, a key 415 corresponding to the switch sensor 440 and a light emitting source 410 will now be discussed. A dome 425 corresponding to the switch sensor 440, is provided at Block 710. The dome 425 is configured to operatively engage the switch sensor 440 when the key 415 corresponding to the switch sensor 440 is depressed.

At Block 720, a dome overlay guide 420 is adhered or otherwise coupled to the dome 425. The dome overlay guide 420 may comprise a light transmissive film such as a light guide film and be configured to receive light emitted (or emitted light 460) from the light emitting source(s) 410 and direct light 460 toward the key(s) 415 of the keypad assembly 400.

At Block 730, the dome overlay guide 420 is secured within the keypad assembly. The dome overlay guide 420 may be secured to the printed circuit board 450 by adhering or otherwise coupling the dome overlay guide 420 to the reflector layer 430 which in turn may be adhered or otherwise coupled to the printed circuit board 450.

In some instances, a keyboard assembly as described herein may be thinner than keyboard assemblies of alternate design, for example designs comprising separate (e.g. laminate) dome overlay guides and light guiding means.

The steps of a method in accordance with any of the embodiments described herein may not be required to be performed in any particular order, whether or not such steps are described in the claims or otherwise in numbered or lettered paragraphs.

The keypad assembly has been described with regard to a number of embodiments. However, it will be understood by persons skilled in the art that other variants and modifications may be made without departing from the scope of the disclosure as defined in the claims appended hereto.

The invention claimed is:

1. A keypad assembly comprising:

a) a dome configured to operatively engage a switch sensor;

b) a dome overlay guide adhered to the dome;

c) a key corresponding to the dome, and configured to operatively engage the dome;

d) a light emitting source configured to emit light;

e) a reflector layer configured to reflect light escaping the dome overlay guide;

f) wherein the dome overlay guide is configured to receive the emitted light and direct the received light toward the key.

2. The keypad assembly of claim 1, wherein the dome overlay guide comprises a light guide film.

3. The keypad assembly of claim 1, wherein the reflector layer is configured to reflect the escaping light toward the key.

4. The keypad assembly of claim 1, wherein the dome overlay guide is between the reflector layer and the key.

5. The keypad assembly of claim 1, further comprising a deflection web configured to seat the key, wherein the deflection web is between the key and the dome overlay guide.

6. The keypad assembly of claim 1, wherein the light emitting source comprises a side firing light emitting diode.

7. The keypad assembly of claim 1, comprising a plurality of keys, and a plurality of corresponding domes.

8. A mobile device comprising the keypad assembly of claim 1.

9. A keypad assembly comprising:

a) a dome configured to operatively engage a switch sensor;

b) a dome overlay guide adhered to the dome;

c) a key corresponding to the dome, and configured to operatively engage the dome;

d) a deflection web configured to seat the key;

e) a side firing light emitting source configured to emit light;

f) wherein the dome overlay guide is configured to receive the emitted light, and direct the received light toward the key;

g) a reflector layer configured to reflect light escaping the dome overlay guide; and h) wherein an actuator is adjacent to a portion of an upper surface of the dome overlay guide.

10. The keypad assembly of claim 9, wherein the dome overlay guide comprises a light guide film.

11. The keypad assembly of claim 9, wherein the reflector layer is configured to reflect the escaping light toward the key.

12. The keypad assembly of claim 9, further comprising a printed circuit board, wherein the reflector layer is positioned between the printed circuit board and the dome overlay guide.

13. The keypad assembly of claim 9, wherein the dome overlay guide is adhered to the reflector layer.

14. The keypad assembly of claim 13, wherein the dome overlay guide comprises at least one cavity configured to emit the received light in a direction toward the key.

15. The keypad assembly of claim 9, wherein the side firing light emitting source comprises a light emitting diode.

16. A method for providing backlighting for a keypad assembly, the keypad assembly comprising a printed circuit board having a switch sensor, a key corresponding to the switch sensor, a light emitting source configured to emit light, the method comprising:

a) providing a dome corresponding to the switch sensor;

b) adhering a light guide film to the dome; and c) securing the light guide film within the keypad assembly, wherein the light guide film is configured to receive the emitted light, and wherein the dome is configured to operatively engage the switch sensor; and d) adhering a reflector layer to the light guide film.

* * * * *